US009777481B2

(12) United States Patent
Kim

(10) Patent No.: US 9,777,481 B2
(45) Date of Patent: Oct. 3, 2017

(54) MULTIFUNCTIONAL ROOFING MATERIAL

(71) Applicant: DAE HAN STEEL CO., LTD., Chungcheongnam-do (KR)

(72) Inventor: Sang-gug Kim, Chungcheongnam-do (KR)

(73) Assignee: Dae Han Steel Co., Ltd., Chungcheongnam-do (KR)

( * ) Notice: Subject to any disclaimer, the term of this patent is extended or adjusted under 35 U.S.C. 154(b) by 210 days.

(21) Appl. No.: 14/274,093

(22) Filed: May 9, 2014

(65) Prior Publication Data

US 2014/0342130 A1 Nov. 20, 2014

(30) Foreign Application Priority Data

May 16, 2013 (KR) ..... 10-2013-0055437

(51) Int. Cl.
*E04D 3/28* (2006.01)
*E04D 3/32* (2006.01)
*E04D 3/35* (2006.01)

(52) U.S. Cl.
CPC ..... *E04D 3/28* (2013.01); *E04D 3/32* (2013.01); *E04D 3/35* (2013.01); *Y10T 428/24628* (2015.01)

(58) Field of Classification Search
CPC .... E04D 3/28; E04D 3/35; E04D 3/32; Y10T 428/24628
USPC ..... 428/141
See application file for complete search history.

(56) References Cited

U.S. PATENT DOCUMENTS 4,283,451 A * 8/1981 Abrahami ..... E04C 2/54 156/71
6,131,363 A * 10/2000 Phillips ..... E04D 3/32 359/595
7,607,266 B2 * 10/2009 O'Hagin ..... E04D 1/30 52/18
2003/0108716 A1 * 6/2003 Nun ..... C03C 17/007 428/141
2007/0240370 A1 * 10/2007 Thiagarajan ..... B29C 47/0028 52/177
2007/0251166 A1 * 11/2007 Thiagarajan ..... B29C 45/372 52/177
2008/0182047 A1 * 7/2008 Thiagarajan ..... E04C 2/543 428/34
2008/0190050 A1 * 8/2008 McClure ..... E04D 3/28 52/200
2009/0255568 A1 * 10/2009 Morgan ..... F24J 2/062 136/246
2009/0293386 A1 * 12/2009 O'Hagin ..... E04D 1/30 52/200
2012/0019917 A1 * 1/2012 Riebel ..... B01D 53/8668 359/599
2012/0164413 A1 * 6/2012 Hara ..... B29C 70/606 428/212

* cited by examiner

*Primary Examiner* — Nathan Van Sell
(74) *Attorney, Agent, or Firm* — Ladas & Parry, LLP

(57) ABSTRACT

A roofing material including: a polycarbonate layer which is a polycarbonate panel having a predetermined thickness and in which a convex portion and a concave portion are alternately repeated in order to diffuse light incident on the roofing material, wherein a two-dimensional array of a plurality of bumps for diffusing light incident on the roofing material, is formed on a surface of each convex portion and a surface of each concave portion of the polycarbonate layer.

9 Claims, 10 Drawing Sheets

MULTIFUNCTIONAL ROOFING MATERIAL

RELATED APPLICATIONS

This application claims the benefit of Korean Patent Application No. 10-2013-0055437, filed on May 16, 2013, in the Korean Intellectual Property Office, the disclosures of which are incorporated herein in their entirety by reference.

BACKGROUND

1. Field

One or more embodiments of the present invention relate to a roofing material, and more particularly, to a multifunctional roofing material.

2. Description of the Related Art

Currently, various research is conducted for saving electric energy used in buildings. In particular, it is reported that most of power consumed in a building is used in illumination of the building and in temperature control of the building. To reduce power consumed in the building, light energy and thermal energy of natural light may be used. As one example of using the energy of natural light, various research for saving power by using energy of natural light through glass windows installed at a building is being conducted.

However, glass windows are installed at lateral sides of a building and thus it is difficult to receive natural light by using the glass windows, and glass has a weak rigidity and is not adequate as a roofing material. Although transparent roofing materials such as fiber reinforced plastics (FRP) or polycarbonate are used in buildings such as livestock buildings or greenhouses, they are not sufficient to cope with external environments of the building, such as natural light or rain water, and thus the internal environment of the building on which the transparent roofing material is installed is poor.

SUMMARY

The present invention provides a multifunctional roofing material that is advantageous for illumination of the interior of a building and is capable of coping with external environments of a building.

Additional aspects will be set forth in part in the description which follows and, in part, will be apparent from the description, or may be learned by practice of the presented embodiments.

According to an aspect of the present invention, a roofing material includes a polycarbonate layer which is a polycarbonate panel having a predetermined thickness and in which a convex portion and a concave portion are alternately repeated in order to diffuse light incident on the roofing material, wherein a two-dimensional array of a plurality of bumps for diffusing light incident on the roofing material, is formed on a surface of each convex portion and a surface of each concave portion of the polycarbonate layer.

The bumps may include surfaces that face each other and are symmetrically inclined at an inclination with respect to, as an axis, a line connecting a vertex of each bump and a central point of the base plane of each bump. The facing surfaces may be symmetrically inclined such that inclinations of the surfaces gradually increase toward the bottom of each bump. Each of the bumps may further include surfaces that face each other in a different direction from a direction in which the two facing surfaces face each other and that are symmetrically inclined at an inclination with respect to, as an axis, a line connecting a vertex of each bump and a central point of the base plane of each bump.

Each side of the base plane of each bump may be adjacent in parallel to one of sides of the base planes of other bumps that are adjacent to each bump. The base plane of each bump may be rectangular and each side of the base plane of each bump is adjacent in parallel to one of the sides of the base planes of four bumps that are adjacent to each bump, and the two-dimensional array of the bumps may have a structure in which the bumps are aligned in a lattice.

The roofing material may further include a coating layer that is coated on the two-dimensional array of the bumps and blocks or absorbs an ultraviolet ray included in light incident on the roofing material. The coating layer may block or absorb the ultraviolet ray by including a material that blocks or absorbs an ultraviolet ray included in light incident on the roofing material. The coating layer may block or absorb an infrared ray included in light incident on the roofing material at the same time when blocking or absorbing the ultraviolet ray.

The coating layer may block or absorb the ultraviolet ray and the infrared ray at the same time by including a material that blocks or absorbs an ultraviolet ray included in light incident on the roofing material and a material that blocks or absorbs an infrared ray included in light incident to the roofing material. The coating layer may include a mixture in which the ultraviolet ray-blocking or absorbing material and the infrared ray-blocking or absorbing material are mixed with an elastic material having a smaller modulus of elasticity than a modulus of elasticity of the polycarbonate layer.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
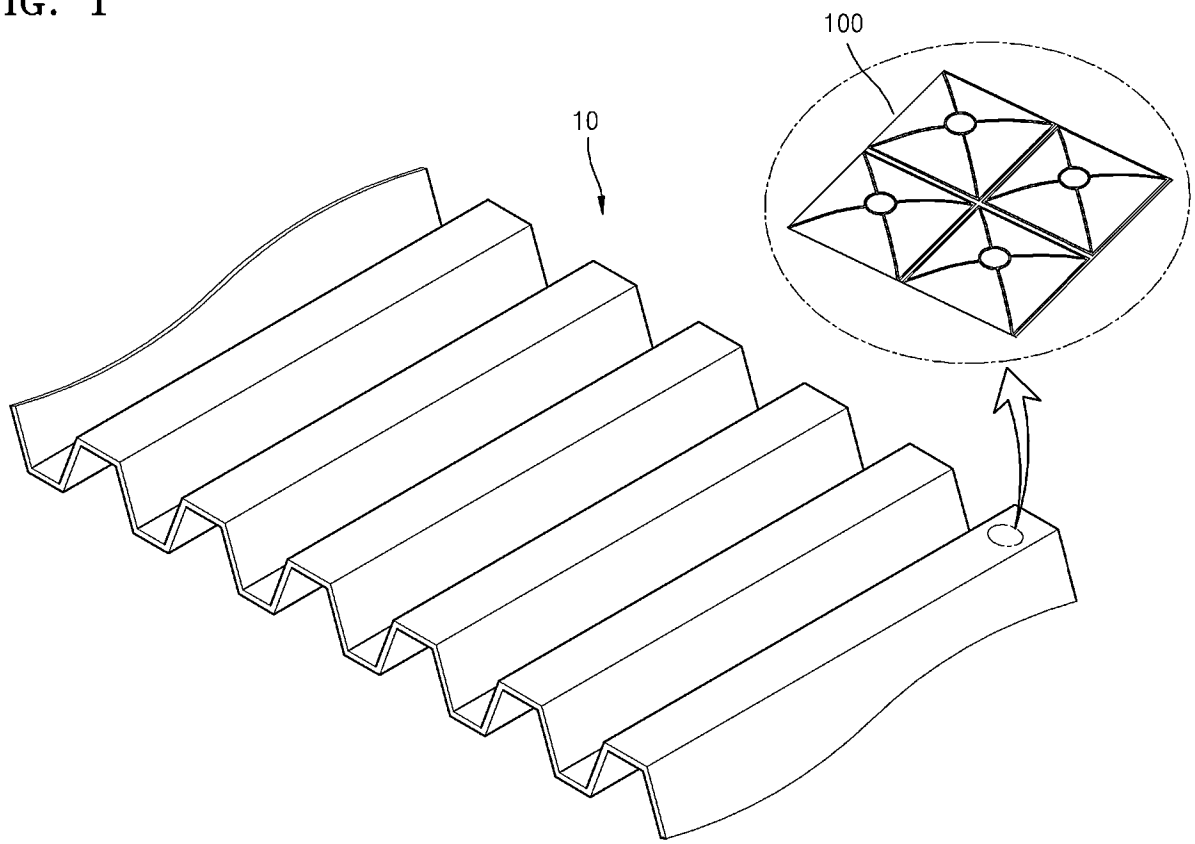
FIG. 1 is a perspective view of a roofing material according to an embodiment of the present invention.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

Figure 2:
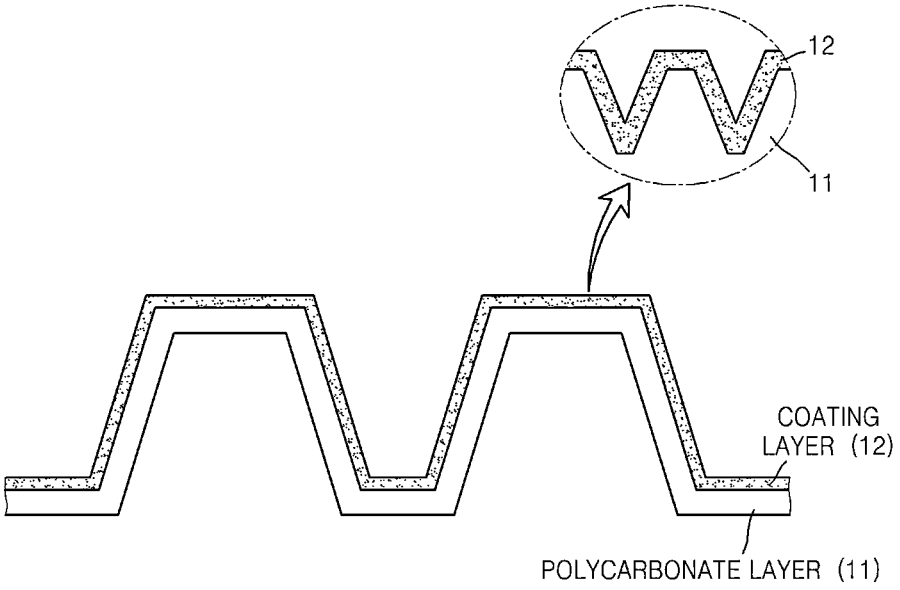
FIG. 2 is a cross-sectional view of a roofing material according to an embodiment of the present invention.

FIG. 1 is a perspective view of a roofing material 10 according to an embodiment of the present invention. FIG. 2 is a cross-sectional view of the roofing material 10 according to an embodiment of the present invention. Referring to FIGS. 1 and 2, the roofing material 10 according to the present embodiment includes a polycarbonate layer 11 and a coating layer 12. The roofing material 10 may be installed over the entire roof or on a portion of a roof of a building. Light transmittivities of the polycarbonate layer 11 and the coating layer 12 which will be described below are almost equal to a light transmittivity of glass, and thus the polycarbonate layer 11 and the coating layer 12 advantageous to illumination of the interior of a building.

Polycarbonate which is a main component material of the polycarbonate layer 11 is a type of a transparent thermoplastic and its rigidity is 250 times greater than that of glass and 30 times or more greater than that of acryl. Also, polycarbonate has an almost the same light transmittivity as glass. Also, polycarbonate is easily processible to, for example, a curved shape or a right-angled shape. The roofing material 10 including the polycarbonate layer 11 formed of a polycarbonate material may be installed in a building that requires illumination by natural light, such as livestock buildings, greenhouses, factories, warehouses, or gymnasiums. Moreover, unlike fiber reinforced plastics (FRP) which is currently used as a main material of roofing materials, polycarbonate is almost nontoxic. The polycarbonate layer 11 may be formed of 100 wt % polycarbonate or of a polycarbonate to which a flame retarding material or the like is added in order to reinforce resistance to fire of the polycarbonate layer 11.

As illustrated in FIGS. 1 and 2, the polycarbonate layer 11 is a polycarbonate panel which has a predetermined thickness and in which a convex portion and a concave portion for diffusing incident light to the roofing material 10 of the polycarbonate layer 11 are alternately repeated. Meanwhile, unlike as illustrated in FIGS. 1 and 2, if the polycarbonate layer 11 is flat, due to a medium change between an air layer and the polycarbonate layer 11, light incident on the polycarbonate layer 11 is uniformly refracted at a boundary surface between the air layer and the polycarbonate layer 11 to proceeds in parallel. On the other hand, in the polycarbonate layer 11 as described above, in which a convex portion and a concave portion are alternately repeated, light that is incident on a predetermined point of a curved portion according to the form of the polycarbonate layer 11 and light that is incident on another point that is adjacent to the above point collide with each other to be scattered.

Due to the scattering of light, light incident on the polycarbonate layer 11 is diffused, and also when light is irradiated to a portion of the polycarbonate layer 11, light is emitted from a broader area of the polycarbonate layer 11 than the portion. As a result, also when light is irradiated only to a portion of the polycarbonate layer 11, the entire interior of the building on which the roofing material 10 is installed becomes bright. Also, due to the light diffusion by the polycarbonate layer 11, directivity of light is reduced, thereby reducing dazzling due to light.

In particular, on a surface of each convex portion and each concave portion of the polycarbonate layer 11 according to the embodiment illustrated in FIGS. 1 and 2, a two-dimensional array 100 of a plurality of bumps is included in order to further diffuse light that is incident on the roofing material 10, that is, light incident on the polycarbonate layer 11. While some of the bumps of the bump array 100, that is, just the two-dimensional array 100 of four bumps are illustrated in FIG. 1 for simplification of the drawing, the two-dimensional array 100 of the bumps is formed over the entire one surface of the polycarbonate layer 11. To light diffusion via each convex portion and each concave portion of the polycarbonate layer, light diffusion of the two-dimensional array 100 of the bumps as illustrated in FIGS. 1 and 2 is added, thereby maximizing light diffusion due to the polycarbonate layer 11.

Also, noise due to rain drops falling on the roofing material 10 may be reduced by using the two-dimensional array 100 of bumps formed on the surface of the polycarbonate layer 11. When rain drops collide with a predetermined object, a portion of kinetic energy of the rain drops is converted into acoustic energy. Compared to a planar panel without bumps, a panel having bumps has a greater surface area, and thus, when rain drops collide with the panel with bumps, kinetic energy of the rain drops are distributed over a broader area compared to when rain drops collide with the planar panel without bumps. As a result, compared to when rain drops collide with a planar panel, noise due to the rain drops is reduced when rain drops collide with the panel with bumps.

Figure 3:
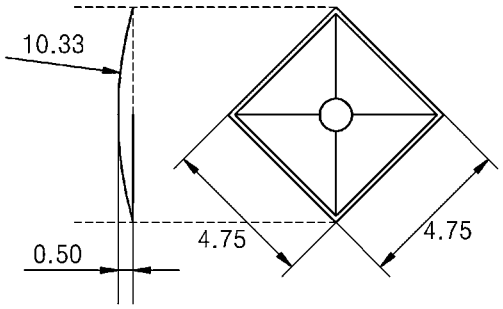
FIG. 3 illustrates each bump of a bump array illustrated in FIGS. 1 and 2 according to an embodiment of the present invention.

FIG. 3 illustrates each bump of the bump array 100 illustrated in FIGS. 1 and 2 according to an embodiment of the present invention. Referring to FIG. 3, each bump of the bump array 100 is in the form of a quadrangular pyramid having a square-shaped base plane and triangular lateral sides. According to the example of FIG. 3, each side of the base plane of each bump is 4.75 mm long, and each bump is 0.5 mm high, and a circumference of each bump is 10.33 mm. As illustrated in FIG. 3, each bump of the bump array 100 includes two surfaces that face each other and are symmetrically inclined at an inclination with respect to, as an axis, a line connecting a vertex of each bump and a central point of the base plane of each bump. That is, each bump has a reverse prism shape that diffuses light incident on each bump. Hereinafter, the light diffusion principle of the polycarbonate layer 11 illustrated in FIGS. 1 and 2 will be described by comparing the light condensing principle of a prism and the light diffusion principle of a reverse prism.

Figure 4:
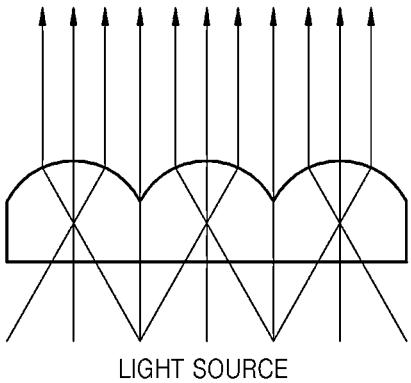
FIG. 4 illustrates the light condensing principle of a typical prism.
Figure 5:
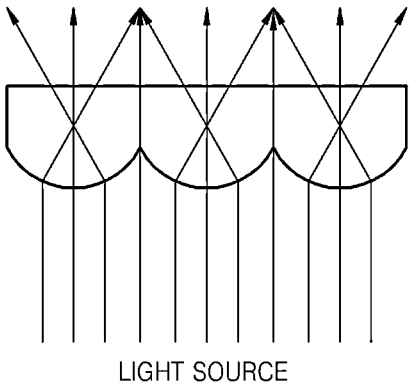
FIG. 5 illustrates the light diffusion principle of a reverse prism applied to a polycarbonate layer illustrated in FIGS. 1 and 2.

FIG. 4 illustrates the light condensing principle of a typical prism, and FIG. 5 illustrates the light diffusion principle of a reverse prism applied to a polycarbonate layer illustrated in FIGS. 1 and 2. In the prism illustrated in FIG. 4, the entire light that is incident from a light source in various directions is refracted in a perpendicular direction at a boundary between a surface of the prism and an air layer so as to be condensed as perpendicular light and be emitted. The prism is used to improve luminance of light in a predetermined area. On the other hand, in the reverse prism illustrated in FIG. 5, light that is perpendicularly incident from a light source is refracted in various directions at a boundary between a surface of the reverse prism and an air layer so as to be diffused and emitted. The bumps illustrated in FIG. 3 may further improve the light emission characteristics of the entire surface of the roofing material 10 by using light diffusion of the reverse prism described above.

As illustrated in FIGS. 1 through 3, each bump has a non-angular vertex, for example, a round or planar vertex so that a user may not be hurt by the bumps formed on the surface of the polycarbonate layer 11. In order to form each bump having a round reverse prim shape with a non-angular vertex, two facing surfaces of each bump formed on the surface of the polycarbonate layer 11 are symmetrically inclined such that inclinations of the surfaces gradually increase toward the bottom of each bump.

A typical prism or a typical reverse prism is used in a light source which emits light in a uniform direction, such as a light emitting diode (LED), and is thus in the form of a triangular bar that includes only two facing surfaces. Unlike light from an LED, a direction of natural light is varied according to solar altitude or time, and thus, in order provide diffusion of light of various directions incident on the roofing material 10, the bumps further include another inclined surfaces that face each other in a direction different from a direction in which the two facing surfaces face each other and are symmetrically inclined at an inclination with respect to, as an axis, a line connecting a vertex of each bump and a central point of the base plane of each bump. Accordingly, the roofing material 10 illustrated in FIGS. 1 and 2 may diffuse light that is incident to the roofing material 10 in various directions regardless of solar altitude or time.

Figure 6:
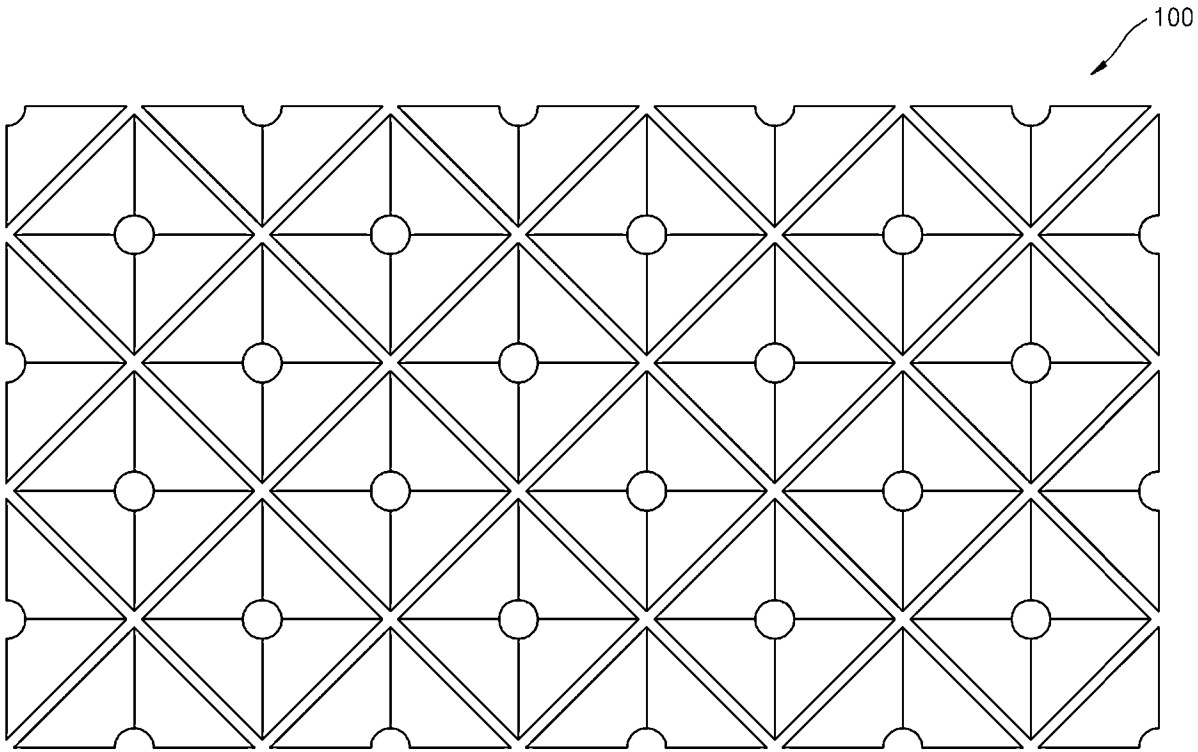
FIG. 6 illustrates an example of a two-dimensional array of bumps illustrated in FIG. 1.

FIG. 6 illustrates an example of the two-dimensional array 100 of the bumps illustrated in FIG. 1. Referring to FIG. 6, each side of the base plane of each bump formed on the surface of the polycarbonate layer 11 is adjacent in parallel to one of sides of base planes of other bumps that are adjacent to each bump. Accordingly, a large number of bumps may be formed on the surface of the polycarbonate layer 11 without any gap, and thus, light diffusion by the polycarbonate layer 11 may be maximized. Moreover, compared to an example where bumps are sparsely formed on the surface of the polycarbonate layer 11, when the bumps are formed on the surface of the polycarbonate layer 11 without any gap, a surface area of the polycarbonate layer 11 may be maximized, and accordingly, noise reduction effects due to the two-dimensional array 100 of the bumps formed on the surface of the polycarbonate layer 11 may be further improved.

According to the example illustrated in FIG. 6, a base plane of each bump formed on the surface of the polycarbonate layer 11 has a rectangular shape, and thus, each side of the base plane of each bump is adjacent in parallel to one of the sides of the base planes of four bumps that are adjacent to each bump, and the array 100 of the bumps has a structure in which the bumps are aligned in a lattice. In the array structure as described above, two pairs of directions in which two respective facing surfaces of each bump face each other are at right angles, and thus, the roofing material 10 illustrated in FIGS. 1 and 2 may diffuse light incident on the roofing material in any direction regardless of solar altitude or time.

Figure 7:
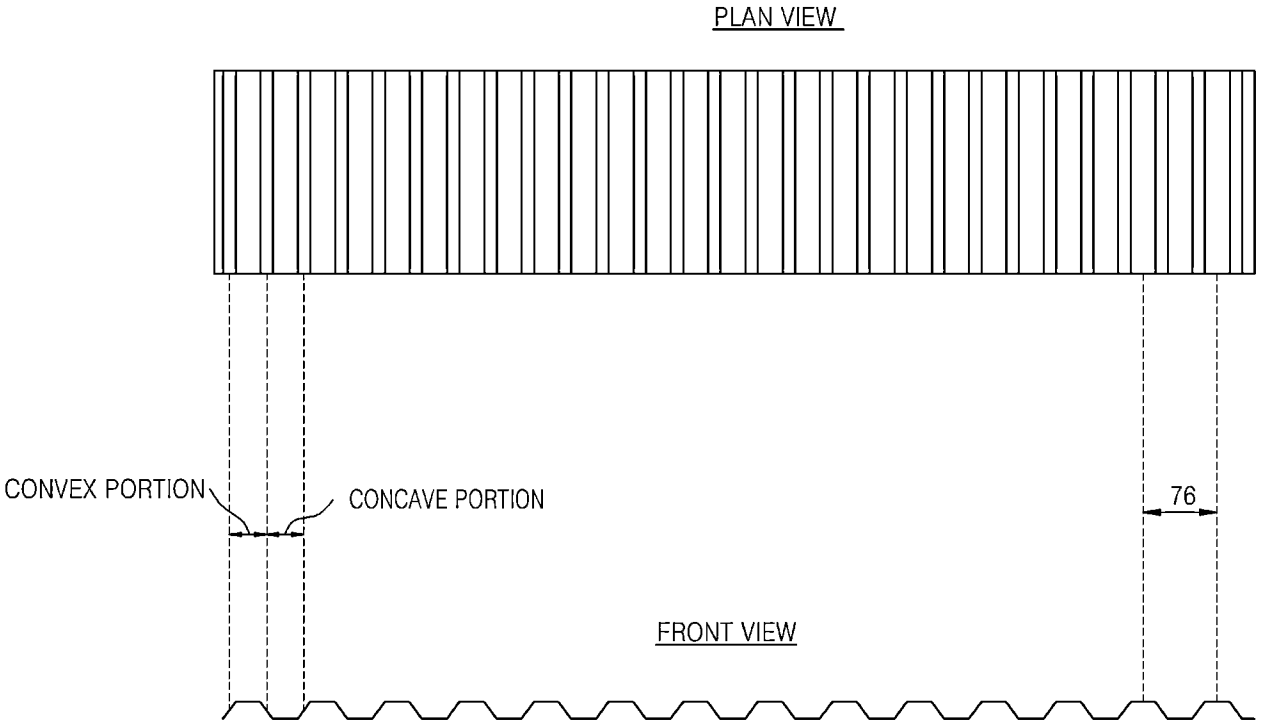
FIG. 7 shows a plan view and a front view of a roofing material according to an embodiment of the present invention.

FIG. 7 shows a plan view and a front view of a roofing material 10 according to an embodiment of the present invention. According to the embodiment illustrated in FIG. 7, each convex portion of the polycarbonate layer 11 is formed of a horizontal surface and two inclined surfaces that are downwardly bent from the horizontal surface, and each concave portion is formed of a horizontal surface and two inclined surfaces that are upwardly bent from the horizontal surface. In addition, the convex portions of the polycarbonate layer 11 have the same length, and the concave portions have the same length, and the convex portions and the concave portion both have the same lengths. For example, the convex portions and the concave portions of the polycarbonate layer 11 may be both 76 mm long.

Figure 8:
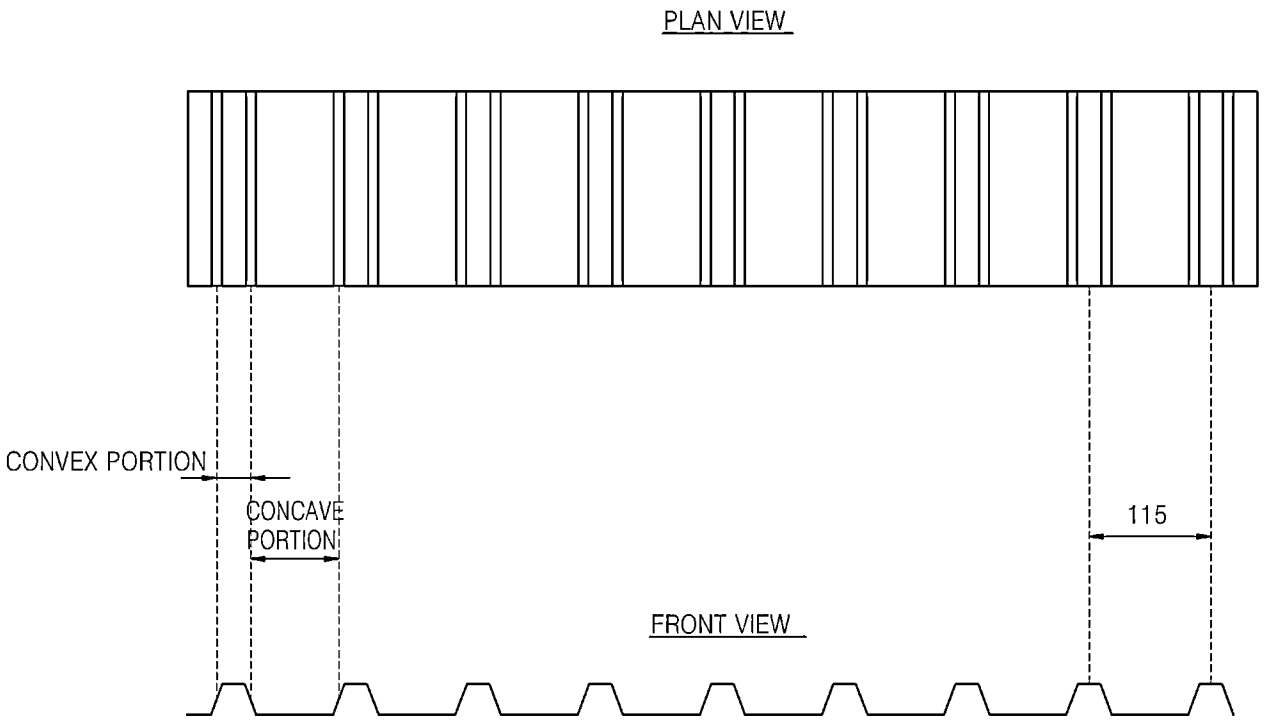
FIG. 8 shows a plan view and a front view of a roofing material according to another embodiment of the present invention.
Figure 9:
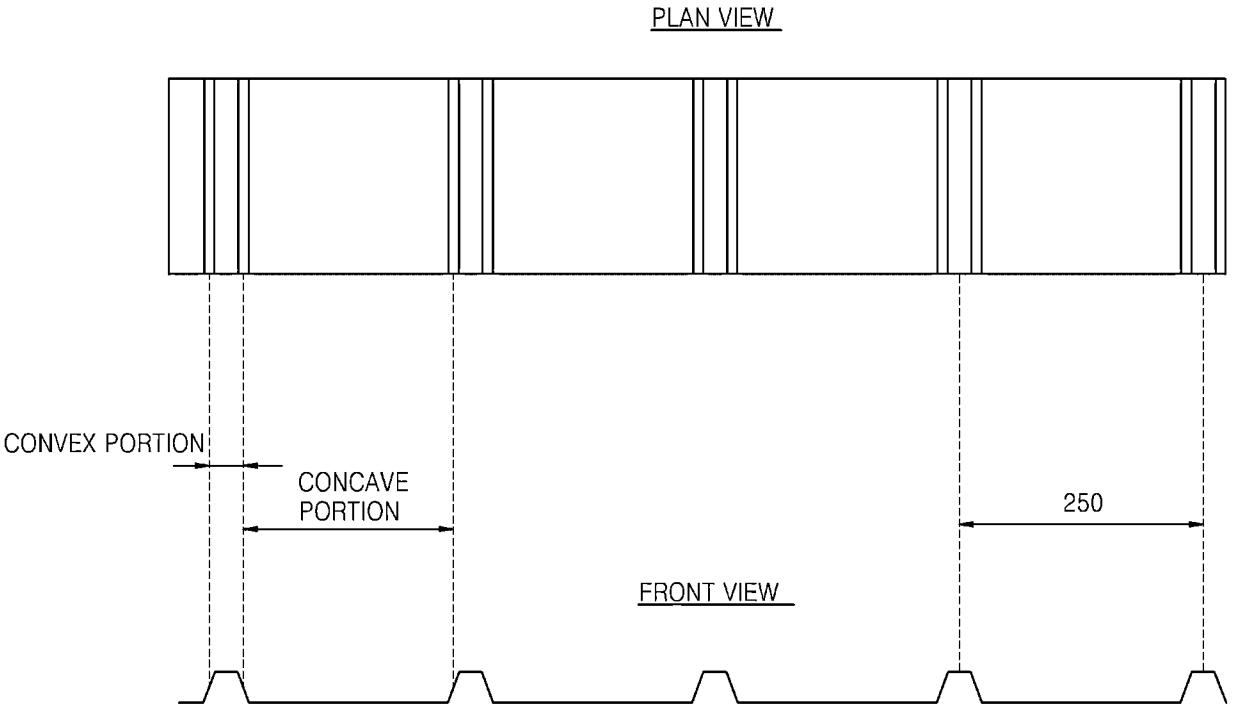
FIG. 9 shows a plan view and a front view of a roofing material according to another embodiment of the present invention.

FIG. 8 shows a plan view and a front view of a roofing material 10 according to another embodiment of the present invention. According to the embodiment illustrated in FIG. 8, each convex portion and each concave portion of the polycarbonate layer 11 have the same shape as those illustrated in the embodiment illustrated in FIG. 7 but the convex portion and the concave portion have different lengths. For example, the concave portion of the polycarbonate layer 11 may be longer than the convex portion, and the concave portion may be 115 mm long. FIG. 9 shows a plan view and a front view of a roofing material 10 according to another embodiment of the present invention. According to the embodiment illustrated in FIG. 9, each convex portion and each concave portion of the polycarbonate layer 11 have the same shape as those illustrated in the embodiment illustrated in FIG. 7 and the convex portion and the concave portion have different lengths as in the embodiment illustrated in FIG. 8, but the concave portion of the polycarbonate layer 11 is remarkably longer than the convex portion than the embodiment of FIG. 8. For example, the concave portion may be 250 mm long.

Figure 10:
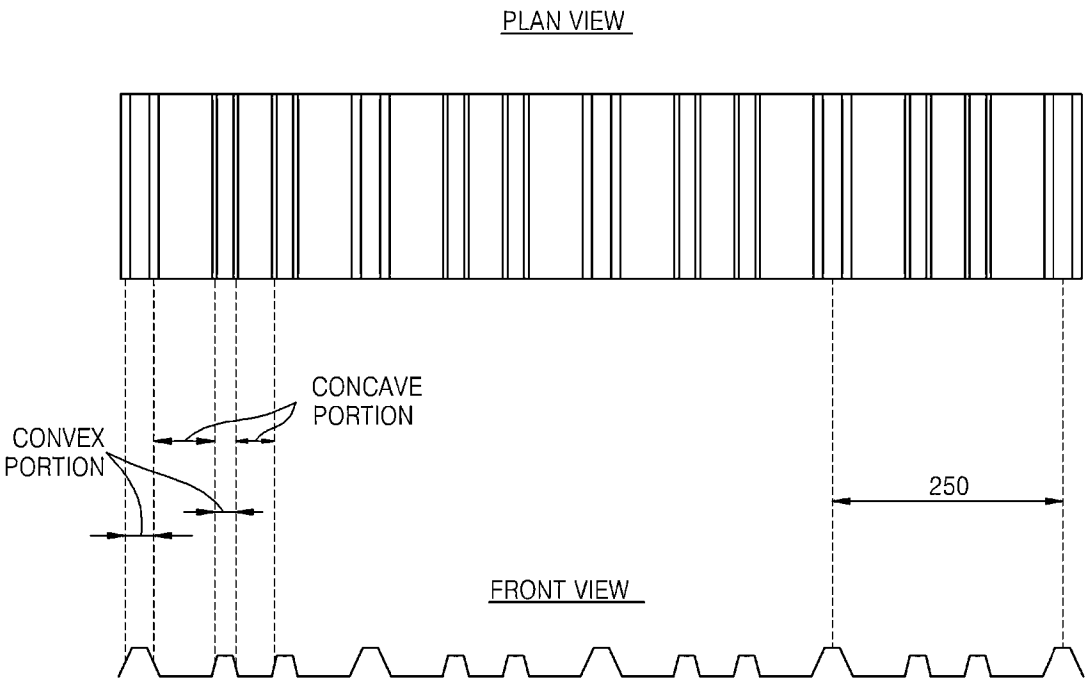
FIG. 10 shows a plan view and a front view of a roofing material according to another embodiment of the present invention.

FIG. 10 shows a plan view and a front view of a roofing material 10 according to another embodiment of the present invention. According to the embodiment illustrated in FIG. 10, each convex portion and each concave portion of the polycarbonate layer 11 have the same shape as those illustrated in the embodiment illustrated in FIG. 7. Also, like the embodiments illustrated in FIGS. 8 and 9, the convex portion and the concave portion have different lengths. However, unlike the embodiments illustrated in FIGS. 7 through 9, lengths of the convex portions of the polycarbonate layer 11 vary, and also, lengths of the concave portions vary. For example, according to the embodiment illustrated in FIG. 10, a relatively long convex portion, a relatively long concave portion, a relatively short convex portion, and a relatively short concave portion, and a relatively short convex portion are arranged in an order, and this arrangement is repeated.

Figure 11:
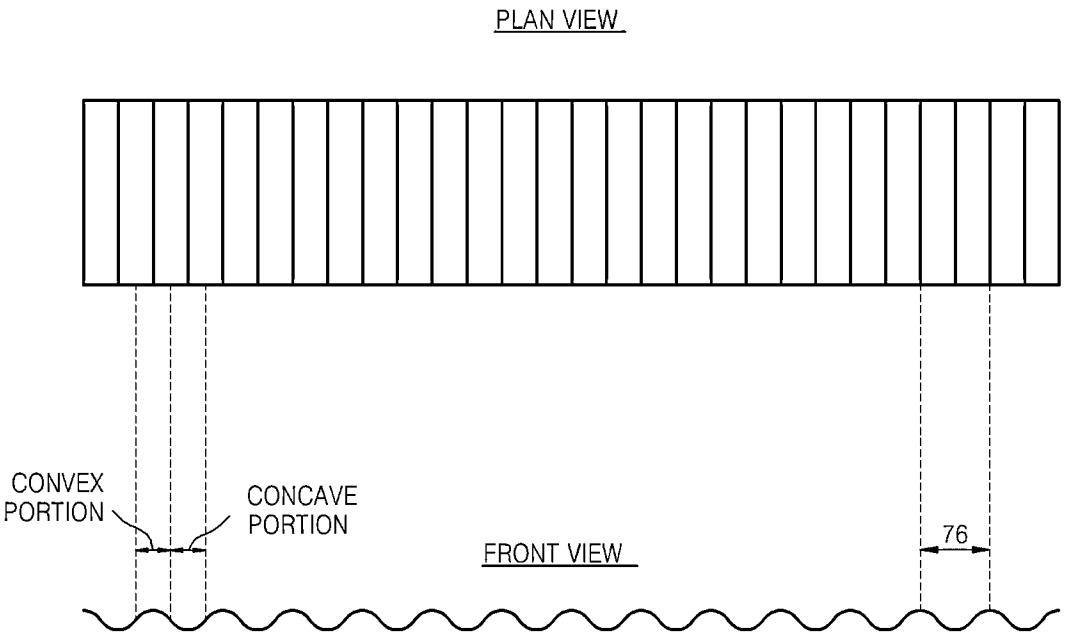
FIG. 11 shows a plan view and a front view of a roofing material according to another embodiment of the present invention.
Figure 12:
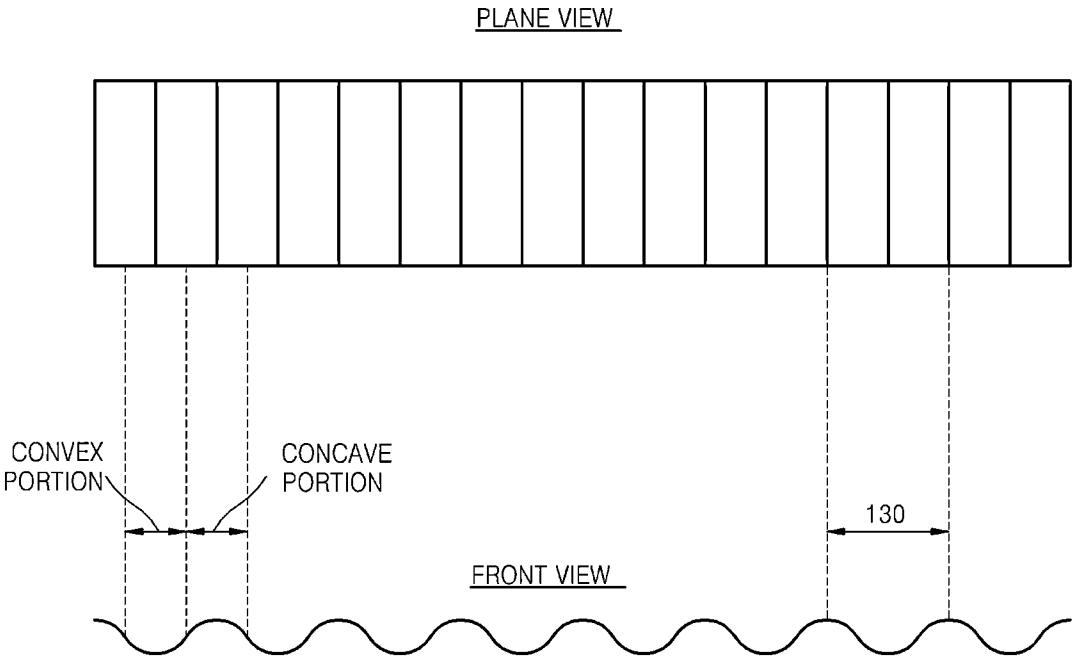
FIG. 12 shows a plan view and a front view of a roofing material according to another embodiment of the present invention.

FIG. 11 shows a plan view and a front view of a roofing material 10 according to another embodiment of the present invention. According to the embodiment illustrated in FIG. 11, each convex portion and each concave portion of the polycarbonate layer 11 has a cylindrical shape that is cut in a fan shape. Also, the convex portions of the polycarbonate layer 11 have the same lengths, and the concave portions have the same lengths, and the lengths of the convex portions and the lengths of the concave portions are the same. For example, the convex portions and the concave portions of the polycarbonate layer 11 may be both 76 mm long. FIG. 12 shows a plan view and a front view of a roofing material according to another embodiment of the present invention. According to the embodiment illustrated in FIG. 12, each convex portion and each concave portion of the polycarbonate layer 11 have the same shape as those in the embodiment illustrated in FIG. 11, but compared to the embodiment illustrated in FIG. 11, the convex portions and the concave portions are longer. For example, the convex portions and the concave portions of the polycarbonate layer 11 may be both 130 mm long. As illustrated in FIGS. 11 and 12, the longer the lengths of the convex portions and the concave portions of the polycarbonate layer 11, sizes of the convex portions and the concave portions also increase.

Natural light includes visible rays, ultraviolet rays, infrared rays, or the like. An ultraviolet ray included in natural light burns human skin and causes skin cancer, and thus, glass that is capable of blocking or absorbing an ultraviolet ray is installed in a building or a sheet to block or absorb an ultraviolet ray is attached on glass windows of a building. Also, if polycarbonate is exposed to an ultraviolet ray for a long period of time, its color is changed to yellow to decrease light transmittivity of the polycarbonate. To solve these problems, a coating layer 12 is formed on the two-dimensional array 100 of the bumps formed on the surface of the polycarbonate layer 11 so as to block or absorb an ultraviolet ray included in light incident on the roofing material 10. The coating layer 12 includes a material that blocks or absorbs an ultraviolet ray included in light incident on the roofing material 10 to thereby block or absorb the ultraviolet ray included in light incident on the roofing material 10. Examples of ultraviolet ray-blocking materials include inorganic nano powders such as titanium oxide ($TiO_2$), zinc oxide (ZnO), cerium oxide (CeO), or organic benzotriazol.

In addition, an infrared ray included in natural light functions as a heat ray and thus if the roofing material 10 transmits an infrared ray included in natural light without any change, internal temperature of a building on which the roofing material 10 is installed may significantly increase. To solve this problem, the coating layer 12 may block or absorb an ultraviolet ray included in light incident on the roofing material 10 and, at the same time, may also block or absorb an infrared ray included in light incident on the roofing material 10. Through the blocking or absorption of the infrared ray, a heat exchange between the interior and the exterior of the building on which the roofing material 10 is installed is reduced, and thus, in summer the building may be kept cool, and in winter, the building may be kept warm. The coating layer 12 may block or absorb an ultraviolet ray included in light incident on the roofing material 10 and may also block or absorb an infrared ray included in light incident on the roofing material 10 at the same time by including a material capable of blocking or absorbing an ultraviolet ray included in light incident on the roofing material 10 and a material capable of blocking or absorbing an infrared ray included in light incident on the roofing material 10. Examples of infrared ray-absorbing materials include types of an inorganic nano powder such as antimony-tin oxide (ATO), indium tin oxide (ITO), and Sb—Zn ($Sb_2O_3$—ZnO).

As described above, noise due to rain drops falling the roofing material 10 is reduced by using the two-dimensional array 100 of the bumps formed on the surface of the polycarbonate layer 11. If a modulus of elasticity of the coating layer 12 is smaller than that of the polycarbonate layer 11, when rain drops collide with the roofing material 10, that is, the coating layer 12, a volume change of the coating layer 12 is greater than a volume change of the polycarbonate layer 11. Accordingly, due to an instantaneous reduction in volume of the coating layer 12, an impact of the rain drops to the roofing material 10 is attenuated. Thus, noise due to the rain drops on the roofing material 10 is further reduced. In other words, due to elasticity of the two-dimensional array 100 of the bumps formed on the surface of the polycarbonate layer 11 and the coating layer 12, noise due to the rain drops falling on the roofing material 10 may be minimized.

The coating layer 12 may be made of a mixture in which the above-described ultraviolet ray-blocking or absorbing material and the above-described infrared ray-blocking or absorbing material is mixed with an elastic material having a smaller modulus of elasticity than a modulus of elasticity of the polycarbonate layer 11. An example of the elastic material is silicone that has almost the same light transmittivity as glass. Silicone has a far smaller modulus of elasticity than that of polycarbonate, and thus, when the coating layer 12 is formed of a mixture as described above, noise due to rain drops falling on the roofing material 10 may be significantly reduced. Consequently, the coating layer 12 may absorb a ultraviolet ray which is harmful to human body, may maintain the same quality of the roofing material 10 by preventing discolorization of the polycarbonate layer 11, may prevent a heat exchange between the interior and the exterior of a building, and may reduce noise due to rain drops falling on the roofing material 10.

According to the one or more embodiments of the present invention, due to the curved structures in which the convex portion and the concave portion of the polycarbonate layer 11 are alternately repeated and the two-dimensional array of the bumps formed on the surfaces of the convex portions and the concave portions, light diffusion by the two-dimensional array 100 of the bumps is added to light diffusion of the convex portions and the concave portions of the polycarbonate layer 11, thereby maximizing light diffusion by the polycarbonate layer 11. In addition, due to the two-dimensional array 100 of the bumps of the polycarbonate layer 11, a surface area of the polycarbonate layer 11 is increased, thereby reducing noise due to rain drops.

As described above, light diffusion may be maximized just based on the shape of the polycarbonate layer 11, and thus, at low costs, light emission characteristics of the entire surface of the roofing material 10 may be improved, dazzling due to light may be reduced, and noise due to rain drops may be reduced. In addition, as the coating layer 12 formed on the polycarbonate layer 11 blocks or absorbs an ultraviolet ray or an infrared ray and noise due to rain drops falling on the roofing material 10 may be reduced, a multifunctional roofing material that is capable of providing a comfortable internal environment of a building by coping with external environments such as natural light or rain drops may be provided.

While this invention has been particularly shown and described with reference to embodiments thereof, it will be understood by those of ordinary skill in the art that various changes in form and details may be made therein without departing from the spirit and scope of the invention as defined by the appended claims. The preferred embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A roofing material comprising:

a polycarbonate layer which is a polycarbonate panel having a predetermined uniform thickness and in which a convex portion and a concave portion are alternately repeated in order to diffuse light incident on the roofing material, wherein:

a two-dimensional array of a plurality of bumps for diffusing light incident on the roofing material, is formed on only upper surface among an upper surface and a lower surface of each convex portion and only upper surface among an upper surface and a lower surface of each concave portion of the polycarbonate layer and no bump is formed on the lower surface of the each convex portion and the lower surface of the each concave portion, the convex portion comprises a first horizontal surface part having an uniform thickness between the upper surface and the lower surface, and two inclined surface parts having an uniform thickness between the upper surface and the lower surface, which are downwardly bent from the first horizontal surface part, and the concave portion comprises a second horizontal surface part having an uniform thickness between the upper surface and the lower surface and two inclined surface parts having an uniform thickness between the upper surface and the lower surface, which are upwardly bent from the second horizontal surface, a first partial array of the two-dimensional array of the bumps is formed on the upper surface of the first horizontal surface part of the convex portion, a second partial array of the two-dimensional array of the bumps is formed on the upper surface of the two inclined surface parts of the convex portion, a third partial array of the two-dimensional array of the bumps is formed on the upper surface of the second horizontal surface part of the concave portion, a fourth partial array of the two-dimensional array of the bumps is formed on the upper surface of the two inclined surface parts of the concave portion, each of the bumps has a reverse prism shape comprising:

first surfaces that face each other and are symmetrically inclined at an inclination with respect to, as an axis, a line connecting a vertex of each bump and a central point of the base plane of each bump; and second surfaces that face each other in a different direction from a direction in which the facing second surfaces face each other and that are symmetrically inclined at an inclination with respect to, as an axis, a line connecting a vertex of each bump and a central point of the base plane of each bump, and the facing first surfaces are symmetrically inclined such that inclinations of the surfaces gradually increase toward the bottom of each bump, and wherein the inclined surface part of the convex portion and the inclined surface part of the concave portion intersect with one another.

2. The roofing material of claim 1, wherein each side of the base plane of each bump is adjacent in parallel to one of sides of the base planes of other bumps that are adjacent to each bump.

3. The roofing material of claim 2, wherein the base plane of each bump is rectangular and each side of the base plane of each bump is adjacent in parallel to one of the sides of the base planes of four bumps that are adjacent to each bump, and the two-dimensional array of the bumps has a structure in which the bumps are aligned in a lattice.

4. The roofing material of claim 1, further comprising a coating layer that is coated on the two-dimensional array of the bumps and blocks or absorbs an ultraviolet ray included in light incident on the roofing material.

5. The roofing material of claim 4, wherein the coating layer blocks or absorbs the ultraviolet ray by including a material that blocks or absorbs an ultraviolet ray included in light incident on the roofing material.

6. The roofing material of claim 4, wherein the coating layer blocks or absorbs an infrared ray included in light incident on the roofing material at the same time when blocking or absorbing the ultraviolet ray.

7. The roofing material of claim 6, wherein the coating layer blocks or absorbs the ultraviolet ray and the infrared ray at the same time by including a material that blocks or absorbs an ultraviolet ray included in light incident on the roofing material and a material that blocks or absorbs an infrared ray included in light incident to the roofing material.

8. The roofing material of claim 1, wherein each of the bumps has a non-angular vertex.

9. The roofing material of claim 1, wherein the roofing material further comprises a coating layer that is coated on the two-dimensional array of the bumps and blocks or absorbs an ultraviolet ray included in light incident on the roofing material, wherein the coating layer comprises a mixture in which the ultraviolet ray-blocking or absorbing material and the infrared ray-blocking or absorbing material are mixed with an elastic material having a smaller modulus of elasticity than a modulus of elasticity of the polycarbonate layer.

* * * * *